United States Patent [19]

Nolte

[11] 4,038,661

[45] July 26, 1977

[54] TUNING LOOP FOR ATTACHMENT TO A CITIZENS BAND RADIO ANTENNA

[76] Inventor: Charles P. Nolte, Rte. 1, Box 129, Aledo, Tex. 76008

[21] Appl. No.: 646,385

[22] Filed: Jan. 2, 1976

[51] Int. Cl.[2] ..... H01Q 1/32

[52] U.S. Cl. ..... 343/715; 343/750

[58] Field of Search ..... 343/749, 750, 751, 752, 343/899, 715, 802, 829, 830, 900

[56] References Cited

U.S. PATENT DOCUMENTS

| | | | |
|---|---|---|---|
| 2,622,197 | 12/1952 | Cruser | 343/802 |
| 2,748,387 | 5/1956 | Klancnik | 343/802 |
| 2,850,732 | 9/1958 | Kandoian et al. | 343/752 |
| 3,089,140 | 5/1963 | Monola | 343/752 |
| 3,299,429 | 1/1967 | McMullin | 343/803 |
| 3,357,663 | 12/1967 | Ivy | 343/709 |
| 3,461,455 | 8/1969 | Rowe | 343/749 |

FOREIGN PATENT DOCUMENTS

| | | | |
|---|---|---|---|
| 350,938 | 7/1937 | Italy | 343/899 |
| 781,773 | 8/1957 | United Kingdom | 343/802 |

OTHER PUBLICATIONS

A.R.R.L. Antenna Book; 1970, pp. 295, 299, published "American Radio Relay League."

*Primary Examiner*—Eli Lieberman
*Attorney, Agent, or Firm*—Arthur F. Zobal

[57] ABSTRACT

A device adapted to be attached to an omnidirectional mobile antenna for a citizens band radio and having an elongated conductive element adapted to be mounted vertically. The device comprises an adjustable clamp adapted to be coupled to the elongated conductive element of the antenna and a bendable metallic member having a generally planer loop-shaped portion surrounding the clamp with two end portions extending inward from the loop and connected to the clamp. The metallic member which forms the loop-shaped portion is coiled such that it defines an angle greater than 360° and only the two end portions of the bendable metallic member are fixed relative to each other whereby the diameter of the loop-shaped portion may be enlarged or contracted.

11 Claims, 4 Drawing Figures

TUNING LOOP FOR ATTACHMENT TO A CITIZENS BAND RADIO ANTENNA

BACKGROUND OF THE INVENTION

This invention relates to a device to be attached to an omni-directional mobile antenna for a citizens band radio to enhance the range of transmission and reception.

Most mobile antennas for citizens band radios now on the market are omni-directional and are formed of an elongated conductive element adapted to be mounted vertically. For motor vehicles, the antennas are smaller than required for maximum efficiency and employ a loading coil to balance out the effect of shortening the antenna. These antenna's, however, have a range less than that desired.

SUMMARY OF THE INVENTION:

It is an object of the present invention to provide a device for enhancing the range of transmission and reception of an omni-directional mobile antenna of the type having an elongated conductive element adapted to be mounted generally vertically.

The device comprises an adjustable clamp means adapted to be coupled to the elongated conductive element, and a bendable metallic member having a generally planer loop-shaped portion surrounding said clamp means with two end portions extending inward from the loop and connected to said claim means. Said two end portions are connected to said clamp means such that when said clamp means is coupled to the elongated conductive element of the antenna, said loop-shaped portion is located in a plane generally perpendicular to the elongated axis of the elongated conductive element.

In a further aspect, said metallic member has only said two end portions near said clamp means fixed with respect to each other whereby the diameter of the loop-shaped portions may be enlarged or contracted. In the preferred embodiment, the metallic member which forms the loop-shaped portion between said two ends portions is coiled such that it defines an angle greater than 360°.

In attaching the device of the present invention to an antenna, preferably it is attached slightly below the loading coil thereof.

Figure 1:
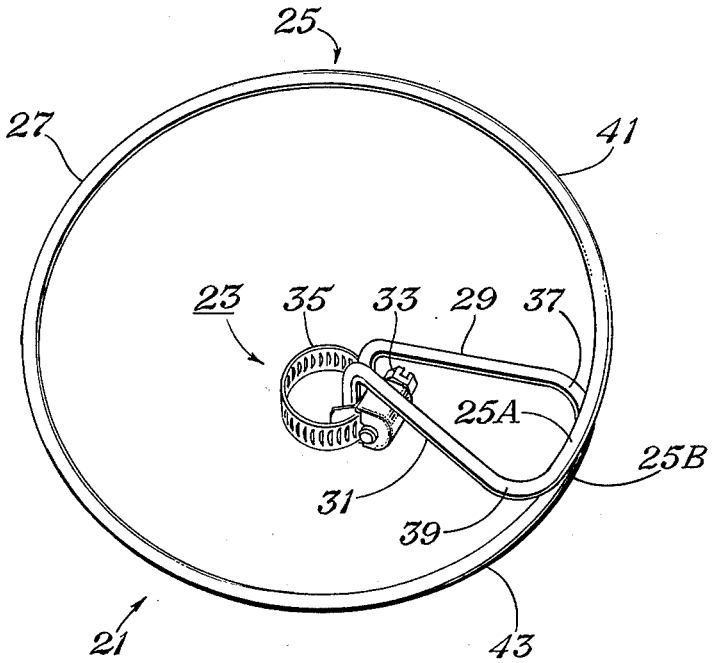
FIG. 1 illustrates the device of the present invention.
Figure 2:
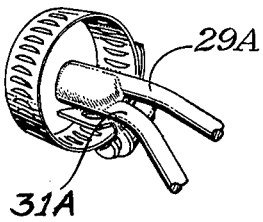
FIG. 2 illustrates the end portions of the device of FIG. 1 attached to a clamp.
Figure 4:
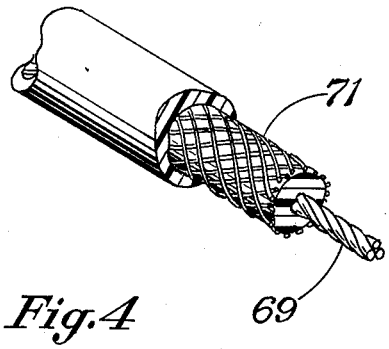
FIG. 4 is an enlarged view of the coaxial cable of FIG. 3 illustrating its shield and central wire.

DETAILED DESCRIPTION OF THE INVENTION:

Referring now to FIG. 1, of the device of the present invention is identified at 21. It comprises a metallic clamp 23 and a bendable metallic member 25 having a generally planer loop shaped portion 27 surrounding the clamp 23 with two end portions 29 and 31 extending inward from the loop and connected to the clamp. In the embodiment shown, the clamp is a conventional hose clamp having an adjustable bolt 33 for increasing or decreasing the diameter of its metallic loop member 35. As seen in FIG. 2, the ends 29A and 31A of the end portions 29 and 31 are welded to the clamp and the portions 29 and 31 bent such that the loop-shaped portion 27 is concentric with the axis of the clamp loop 35. The metallic member 25 forming the loop-shaped portion 27 is coiled such that it defines an angle greater than 360° between points 37 and 39. Thus, portions 25A and 25B overlap forming a space between the end portions 29 and 31. Since only the ends 29A and 31A of the metallic member are fixed relative to each other, the diameter of the loop 27 may be increased or decreased by pulling outward or by pushing inward at points 41 and 43, for example. The overlapping portions 25A and 25B allow the circular configuration to be maintained as the diameter of the loop is increased up to a certain point.

Figure 3:
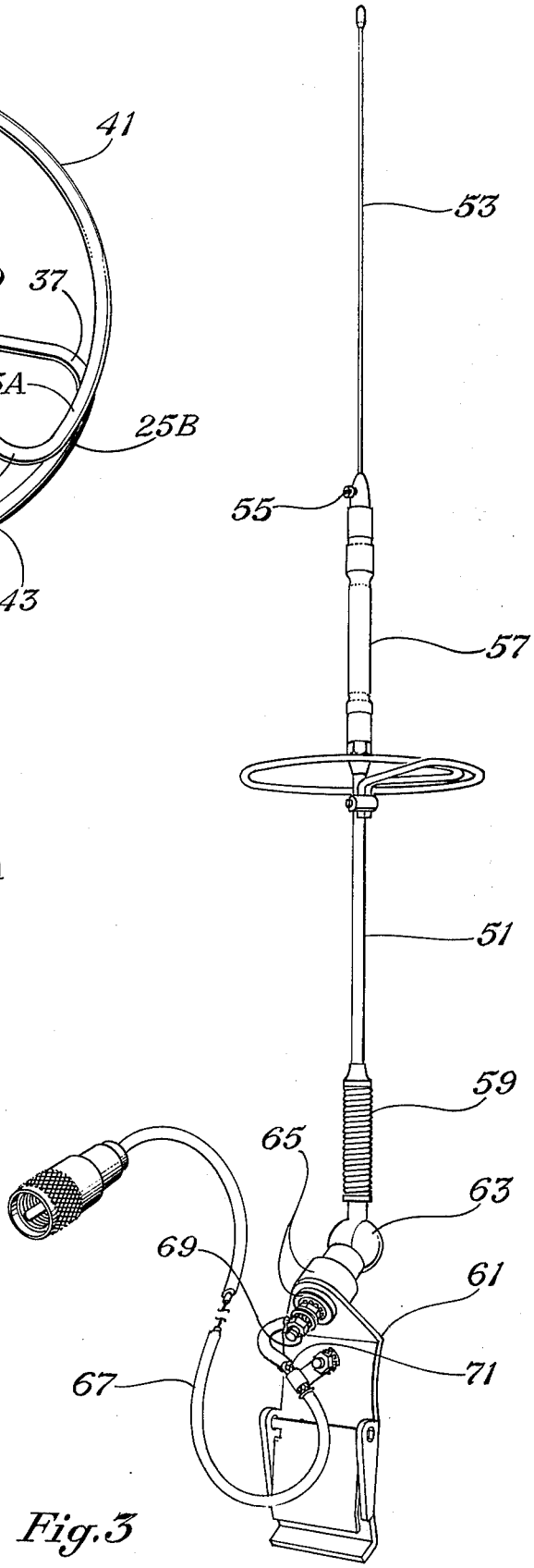
FIG. 3 illustrates the device of FIG. 1 attached to an antenna.

FIG. 3 illustrates the device of FIG. 2 attached to an omni-directional mobile antenna employed for a citizens band radio. This antenna is adapted to be attached to the gutter of the roof of an automobile or for example to the edge of a shield of a motorcycle. The antenna comprises an elongated conductive element comprising a base rod 51 having a telescoping top rod 53 with a set screw 55 for securing the top rod in place after proper adjustment. A loading coil 57 is located at about the center of the antenna. A flexible spring 59 is attached to the lower end of the antenna to allow it to flex or bend if it hits an upper object. The spring 59 is connected to a mount or clamp 61 for attaching the antenna in place. A ball socket 63 is employed for allowing the antenna to be located in a vertical position once it is attached in place. The antenna is insulated from the mount 61 by means of an insulating rings 65. A coaxial cable 67 is provided with its inner electrical conductor 69 connected to the antenna and its shield 71 connected to the metallic mount 61.

Preferably the device is attached below but near the loading coil 57. In attaching the device 21 to the antenna, preferably the telescoping rod 53 first is adjusted to the desired position to obtain maximum reception and transmission. The clamp 23 is then fitted around the antenna to a position below the loading coil and the device is moved upward or downward to a position to achieve maximum transmission and reception. The clamp 35 then is clamped in place to the desired position whereby the loop-shaped portion 27 surrounds the antenna. Further adjustment may be made before or after attachment by increasing or decreasing the diameter of the loop 27 as described previously.

Preferably the device 21 is clamped to the antenna such that the end portions 29 and 31 extend rearward of the direction of travel of the vehicle. When clamped in this manner, the end portions 29 and 31 act as an air foil and prevent the antenna from being whipped by the wind during travel of the vehicle.

In one embodiment, the metallic member 25 forming the loop-shaped portion 27 is formed of mild steel. The cross-sectional diameter of the metallic member 25 is $\frac{1}{8}$ of an inch. The loop shaped portion 27 has a normal diameter of three inches and is intended for use on an antenna having a maximum length of about 20 inches. As indicated above, the diameter of the loop 27 may be increased or decreased to achieve maximum tuning. For larger antenna's, the device 21 may have a normal diameter or up to five inches or greater. It has been found that the device of the present invention when attached to a mobile omni-directional antenna of a citizens band radio, clarifies voice transmission and reception, reduces interference and reflection from nearby metal objects and greatly increases the effective range of transmission and reception.

If desired a small coil or capacitor may be connected between portion 25B and end portion 31 near the clamp 35 to reduce outside interference and enhance signal reception. When connected in this manner the coil or capacitor will not interfere with adjustment of the diameter of the loop 27 to any great extent.

I claim:

1. A device adapted to be attached to an omni-directional mobile antenna for a radio having an elongated conductive element, comprising:

adjustable metallic clamp means adapted to be coupled to the elongated conductive element, and a bendable metallic member having a generally planer loop-shaped portion generally surrounding said clamp means with at least one end portion extending inward from the loop and fixedly connected to said clamp means, said portion of said metallic member which forms said loop-shaped portion being coiled such that it defines an angle greater than 360°, said one end portion being connected to said clamp means such that when said clamp means is coupled to the elongated conductive element of the antenna, said loop-shaped portion surrounds the elongated conductive element of the antenna and is located in a plane generally perpendicular to the elongated axis of the eleongated conductive element of the antenna.

said inward extending end portion between said loop-shaped portion and said clamp means being generally in the same plane as that of said loop-shaped portion, the dimension of said device in a plane perpendicular to the pane of said loop-shaped portion being less than the diameter of said loop-shaped portion, said clamp means comprising:

a metallic loop member having two ends adapted to be opened to be fitted around the elongated conductive element of the antenna from a position transverse to the axis thereof and to be closed and tightened around the elongated conductive element of the antenna, and means for tightening said metallic loop member of said clamp means around the elongated conductive element of the antenna.

2. A device adapted to be attached to an omni-directional mobile antenna for a radio having an elongated conductive element, comprising:

adjustable metallic clamp means comprising a metallic loop member adapted to be coupled to the elongated conductive element.

a generally planer ring-shaped metallic member generally surrounding the axis of said metallic loop member of said clamp means.

two connecting members defining an angle less than 90° and extending inward from said ring-shaped metallic member and connected to said clamp means, the dimension of said device in a plane perpendicular to the plane of said ring-shaped metallic member being less than the outside diameter of said ring-shaped metallic member, said metallic loop member of said clamp means having two ends adapted to be opened to be fitted around the elongated conductive element of the antenna from a position transverse to the axis thereof and to be closed and tightened around the elongated conductive element, means for tightening said metallic loop member of said clamp means around the elongated conductive element of the antenna, said two connecting members being connected to said clamp means such that when said clamp means is coupled to the elongated conductive element of the antenna, said ring-shaped metallic member surrounds the elongated conductive element of the antenna and is located in a plane generally perpendicular to the elongated axis of the elongated conductive element of the antenna, said two connecting members extend inward from said ring-shaped metallic member and then in a direction generally parallel with the axis of said ring-shaped metallic member defining two connecting ends, said two connecting ends being fixedly connected close together to said metallic loop member of said clamp means on the inside thereof.

3. A device adapted to be attached to an omni-directional mobile antenna for a radio having an elongated element, comprising:

adjustable clamp means comprising a loop member adapted to be coupled to the elongated element of the antenna, a bendable metallic member having a generally planer loop-shaped portion surrounding the axis of said loop member of said clamp means and having end means extending inward from said loop-shaped portion and being fixedly connected to said clamp means, said portion of said metallic member which forms said loop-shaped portion is coiled such that it defines an angle greater than 360°, said loop-shaped portion having overlapping portions which define an angle relative to the center of said loop-shaped portion which is substantially less than 180°, said end means extending inward from said loop-shaped portion and then in a direction generally parallel with the axis of said loop-shaped defining connecting end means, said connecting end means being connected to said clamp means, said loop member of said clamp means having two ends adapted to be opened to be fitted around the elongated element of the antenna from a position transverse to the axis thereof and to be closed and tightened around the elongated element of the antenna, and means for tightening said loop member of said clamp means around the elongated element of the antenna, said end means being connected to said clamp means such that when said clamp means is coupled to the elongated element of the antenna, said loop-shaped portion surrounds the elongated element of the antenna and is located in a plane generally perpendicular to the elongated axis of the elongated element of the antenna, the dimension of said device in a plane perpendicular to the plane of said loop-shaped portion being substantially less than the diameter of said loop-shaped portion.

4. The device of claim 3 wherein:

the overlapping portions of said loop-shaped portion define an angle relative to the center of said loop-shaped portion which is less than 90°.

5. The device of claim 3 wherein:

said clamp means comprises a metallic loop member, said connecting end means being connected to said clamp means on the inside of said metallic loop member of said clamp means.

6. The device of claim 5 wherein:

the overlapping portions of said loop-shaped portion define an angle relative to the center of said loop-shaped portion which is less than 90°.

7. The device of claim 3 wherein:

said end means comprises two end portions which extend inward from said loop-shaped portion and then in a direction generally parallel with the axis of said loop-shaped portion defining two connecting end means which are fixedly connected to said clamp means, said two end portions defining an angle which is substantially less than 180°.

8. The device of claim 7 wherein:

said two end portions define an angle which is less than 90°.

9. The device of claim 7 wherein:

said clamp means comprises a metallic loop member, said two connecting end means are fixedly connected to said clamp means on the inside of said metallic loop member of said clamp means.

10. The device of claim 9 wherein:

said two end portions define an angle which is less than $\pi°$.

11. The device of claim 3 wherein:

the length of said end means being substantially less than the diameter of said loop-shaped portion.

* * * * *